US006907837B2

(12) United States Patent
Pufahl

(10) Patent No.: US 6,907,837 B2
(45) Date of Patent: Jun. 21, 2005

(54) MOORING ASSEMBLY

(76) Inventor: Joseph A. Pufahl, 4 Tutthill Dr., Box 656, Shelter Island, NY (US) 11964

( * ) Notice: Subject to any disclaimer, the term of this patent is extended or adjusted under 35 U.S.C. 154(b) by 0 days.

(21) Appl. No.: 10/234,758

(22) Filed: Sep. 4, 2002

(65) Prior Publication Data

US 2004/0040486 A1 Mar. 4, 2004

(51) Int. Cl.[7] ..... B63B 21/00
(52) U.S. Cl. ..... 114/230.1; 114/221 R
(58) Field of Search ..... 114/221 R, 230.1, 114/230.15

(56) References Cited

U.S. PATENT DOCUMENTS

| | | | | |
|---|---|---|---|---|
| 1,536,701 A | | 5/1925 | Buckingham et al. | |
| 2,347,718 A | | 5/1944 | Terry | |
| 3,431,568 A | | 3/1969 | Brown | |
| 4,143,613 A | * | 3/1979 | Paul | 114/230.25 |
| 4,529,388 A | | 7/1985 | Jones et al. | |
| 5,381,749 A | * | 1/1995 | Larson | 114/221 R |
| 5,499,591 A | * | 3/1996 | Chippas | 114/230.15 |
| 5,740,751 A | * | 4/1998 | Peever et al. | 114/221 R |

* cited by examiner

*Primary Examiner*—Stephen Avila
(74) *Attorney, Agent, or Firm*—Dilworth & Barrese LLP

(57) ABSTRACT

A mooring assembly including two detachably coupled elements configured and dimensioned so that one of the elements passes through the other element as the boat is being piloted in a travel direction by the unassisted boater. The elements engage one another upon reversing the direction of advancement of the boat.

12 Claims, 1 Drawing Sheet

20
24
38
22
18
D
26
7
10
12
16
14

28
32
30

22
36
20

20
44
42
26

MOORING ASSEMBLY

BACKGROUND OF THE INVENTION

1. Field of the Invention

The invention relates to a device for mooring a water craft. Particularly, the invention relates to a mooring assembly for water craft configured to provide a single point contact engagement between a hook portion and a buoy.

2. Description of the Prior Art

In the operation of small boats, it is frequently necessary to moor the boat away from the dock usually by attaching a mooring line to a buoy having a mooring ring. Since the ring or hoop carried by the buoy may be several feet beyond the reach of the boat operator, considerable difficulty is often encountered in securing the clip on the end of a mooring line to the mooring buoy and in inclement weather a certain degree of danger may be involved. Similar difficulties are encountered in disengaging the mooring line and in rough weather the difficulties may be sufficient to require the cutting of the mooring line rather than the disengagement of the line from the buoy.

Despite these difficulties and attendant occasional hazards, it is the general practice to attach a clip on the end of a mooring line to the ring of a mooring buoy by manually bringing the parts together. Alternately, the mooring line may be threaded through the loop on the mooring buoy and secured with a knot. In either case the actions required are awkward, difficult and occasionally dangerous.

Reaching the buoy to tie the mooring line can be difficult. In the case of the dock rail, at least two persons are usually necessary; one person jumps onto the dock to tie the mooring line while another remains aboard to pilot the boat. One person pilots the boat while the second reaches down for the buoy and pulls it up to tie the line. If the buoy cannot be pulled up, due to factors such as its weight or tension in its anchor line, the second person must reach down to the buoy while tying the line.

These procedures can present real difficulties and even hazards to a boater. An unassisted boater may even find it impossible to moor his boat. Reaching over the side of the boat to a buoy may be dangerous, especially in rough waters (a time when the buoy anchor line is likely to be in tension such that the buoy cannot be lifted).

Attempts have been made at procedures for mooring a boat to a buoy utilizing the additional reach provided by a standard boat hook. For example, U.S. Pat. No. 1,536,701 to Buckingham, discloses a mooring device which is provided with a swivel ring and a hook coupled to a boat and configured to engage the ring so that the free end of the hook extends into the ring. This device may be difficult to use in many instances. For example, a swivel ring that is not situated in a rigid upright position or rough waters can make engagement of the hook with the ring difficult. Engagement of the hook, thus, necessarily involves a person to properly position the ring relative to the hook.

The limitations of the above-described mooring device, and particularly, necessity of bringing the hook over the ring in a manual manner is typical of the current designs. The present invention was developed to effectively address the problem of easy, safe moorage of a boat to a buoy, by one unassisted person.

OBJECTS OF THE INVENTION

It is therefore an object of the invention to provide a mooring assembly having a simple structure allowing the boater to moor a boat to a buoy while still operating the boat.

Still another object of the invention is to provide a mooring assembly facilitating moorage of a boat under adverse meteorological conditions.

Yet a further object is to provide a mooring assembly adjustable to provide a reliable moorage of differently dimensioned and shaped watercrafts.

SUMMARY OF THE INVENTION

Consistent with the above-formulated objects, a mooring assembly includes a floating buoy assembly provided with a first engaging element, such as a hoop, and a second engaging element, such as hook, which is configured and dimensioned so that it is carried through the hoop as the boat advances along one direction and engages the hoop from inside as the boater reverses the direction of the boat's advancement.

One of the advantages of the inventive assembly is that a boat can be moored by an unassisted boater who can concentrate on piloting the boat while maneuvering it so that the hook moves through the hoop. As a consequence, the boater moors the boat by properly maneuvering the latter and, thus, avoids a manual mooring operation, which often leads to a hazardous situation both for the boater and the boat.

In accordance with one aspect of the invention, the hoop and the hook are dimensioned to provide a sufficient clearance therebetween as the hook is being carried through the hoop.

Advantageously, the outer dimension of the hook is so smaller than the inner dimension of the hoop that a slight change of the boat course, when the boat reverses the direction of travel relative to the hoop, can bring the hook into engagement with the hoop.

In accordance with another aspect of the invention, the hook can have a variety of shapes including a U-shape and polygonal shapes. Advantageously, the hook is shaped so that voluntary disengagement between the hook and the hoop is minimized.

A further object of the invention involves the mooring assembly and particularly the hoop and the hook both made from fluorescent material making these assembly components visible in the darkness or under adverse meteorological conditions providing decreased visibility of the assembly. The more visible the structure, the easier and safer the moorage.

BRIEF DESCRIPTION OF THE DRAWINGS

The above and other objects, advantages and features will become more readily apparent from a specific description accompanied by the flowing drawings, in which.

SPECIFIC DESCRIPTION

Figure 1:
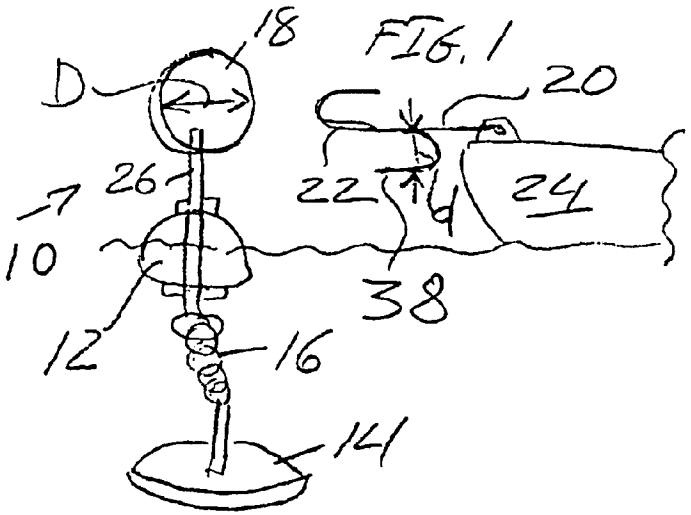
FIG. 1 is perspective view of the inventive assembly, showing its use in mooring a boat to a buoy.
Figure 2:
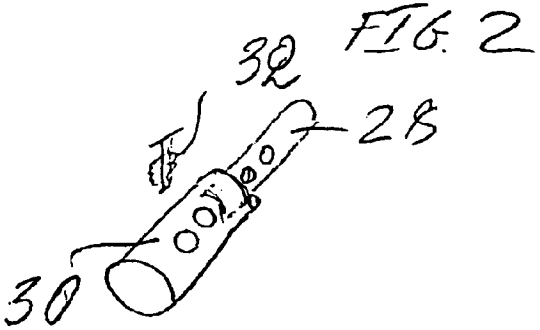
FIG. 2 is a perspective view of a buoying rod in accordance with the present invention.
Figure 3:
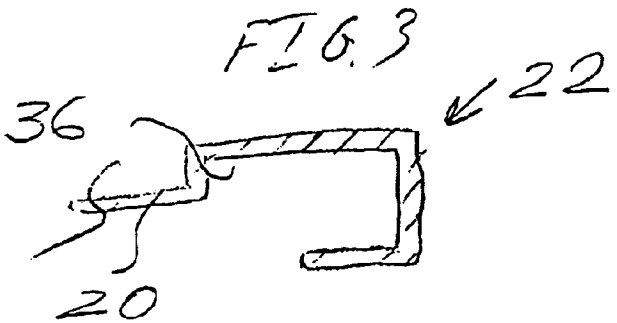
FIG. 3 is a perspective view of one embodiment of the hook in accordance with the present invention.

Referring to FIGS. 1–3, a mooring assembly 10 includes a buoy 12 provided with a hoop 18, which preferably has an annular cross-section, but can have any other cross-sections including polygonal or irregular, for example. To facilitate the moorage of the boat 24 approaching the buoy 12 at an initial angle and at a low speed, a hook 22 mounted on the bow of the boat is dimensioned to be carried through the hoop 18 along a travel direction indicated by arrow A. Having passed through the hoop 18, the boater reverses the direction of boat advancement so that the boat backs up at an angle slightly different from the initial angle to provide engagement of the hook 22 with the hoop 18. As a result, the unassisted boater can moor the boat alone without experiencing any particular difficulty.

The mooring assembly 10 further includes an anchor 14 lying under water and coupled to the buoy 12 by a flexible component 16 to allow tensioning of the hoop 18 upon engagement with the hook 22. The anchor is preferably of a mushroom type, but can be any other type preventing voluntary displacement of the buoy beyond the length of the flexible component which can be any elongated element including, but not limited to, a chain, a cable, a rope, a cord and the like.

As shown in FIG. 1, the buoy 12 is provided with a rod 26 extending transversely to the water surface at a distance that allows the boater to clearly see the hoop 18 attached to the top end of the rod 26. Still another requirement imposed on the rod 26 is that the distance should approximate a distance at which the hook 22 is spaced from the water surface, or in other words, should correspond to the height of the bow. To attain it, the rod 26 is vertically adjustable. As better seen in FIG. 2, the rod can have a telescopic structure including an upper rod portion 28 sliding within a lower rod portion 28 and a fastener 32 fixing these portions relative to one another at the desired position. Alternatively, the upper 28 and lower 30 portions of the rod 26 can be provided with mating threaded surfaces allowing these portions to displace relative to one another. The fastener 32 can be a pin fixing the lower and upper portions of the rod 26 in the desired position by extending through a single hole provided in the lower portion 30 of the rod and through a respective one of a row of openings 34 formed in the upper portion 28 of the rod 26. Optionally, each of the lower and upper portions of the rod 26 can be provided with a respective row of openings. Alternatively, the fastener can be a screw advancing toward the upper portion 28 and pressing against it when the rod extends at the desired height.

Still another modification of the adjustment mechanism can include the rod 26 made as a one-piece body fixed at one end to the hoop 18 and extending therefrom through the buoy to have the opposite end fixed to the flexible component 16. To adjust the overall height of the assembly 10, the rod 26 can be displaceable relative to the buoy 12 to vary a distance between the buoy and the hoop. A further modification involves a structure in which the hoop 18 is displaceable relative the rod 26.

The hook 22 is provided on a free end of an elongated shaft 20 removably mounted on the bow of the boat. The hook can be formed unitarily with the shaft or can be a separate part. The largest outer dimension of the loop of the hook "d" is preferably 30–60% smaller than the diameter "D" of the hoop 18 to allow them to interengage by slightly changing the course of the boat as the latter backs up. The hook can have a variety of shapes. For example, as shown in FIG. 3, the hook is provided with a polygonal shape forming a step 36 relative to the shaft 20. Such a shape improves reliability of the engagement between the hook 22 and the hoop 18.

To prevent uncontrollable advancement of the boat toward the hoop 18, the free end of the shaft 20 can be provided, in addition to the hook 22, with another hook 38 opening in a direction opposite to the one of the hook 22. To ensure the engagement between the hoop and the extra hook 38, the latter can be dimensioned to have a respective largest dimension "d" equal approximately half (50%) the inner diameter D of the hoop. The shaft 20, in turn, can be mounted pivotally on the bow of the boat 24 to facilitate penetration of the hook through the hoop 18. The shaft 20, like the rod 26, can have a structure allowing the boater to adjust the overall length of the shaft if the circumstances call for it. Additionally, the shaft 20 can be provided with a mechanism for locking the shaft in a desirable angular position with respect to the horizontal.

Figure 4:
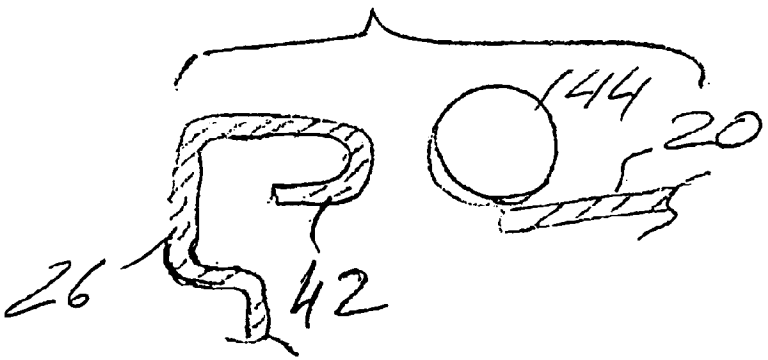
FIG. 4 is a view of another embodiment of the inventive mooring assembly.

Alternatively, the rod 26 can be provided with a hook, whereas the shaft 20 can have a hoop. As shown in FIG. 4, in using this embodiment of the inventive mooring assembly, the rod 26 has a bent upper portion formed with at least one hook 42 dimensioned to be engaged by a hoop 44, which, in turn, is provided either below or above and fixed to the free end of the shaft 20. The principle of operation is similar to the previously discussed embodiment. In particular, the boater navigates the boat so that the hook 42 extends through the hoop 44 and, as the latter comes into contact with the rod 26, the travel direction of the boat is reversed to provide engagement between the hook and the hoop. Similarly to the above-discussed embodiment, the bent portion of the rod 26 can be modified to have an additional hook 40 extending at an angle from the hook 42 to improve and facilitate the moorage of the boat. Preferably, to prevent unbalance of the buoy 12, the bent portion of the rod 26 is shaped to have its center of gravity located along the longitudinal axis of the rod. As the boat is moored, it is possible to use various means for locking the hook on the hoop.

Often darkness or inclement weather can dramatically worsen the moorage of the boat and render the hoop 44 or 18 practically invisible. A layer of fluorescent material, or a light-reflective layer, for example a sheet of vinyl provided with glass beads, can be laminated with a metallic body of the hoop to increase visibility of the mooring assembly. Alternatively, the hoop and/or the hook can be entirely made from polymeric fluorescent and/or light-reflective material which greatly helps the boater locate the mooring assembly when the visibility is limited.

While the invention has been disclosed with respect to preferred embodiments, various changes can be made without departing from the scope of the invention as defined by the appending claims.

What is claimed is:

1. A mooring assembly comprising a first element attachable to a buoy and a second element attachable to a boat and dimensioned to extend through the first element along a first direction as the boat advances along a travel direction and engage the first element upon displacement of the second element in a direction opposite to the first direction as the boat reverses the travel direction after the second element has been carried through the first element, wherein at least one of the first and second elements is made from a corrosion-resistant material laminated with a fluorescent material or a light-reflecting material.

2. The mooring assembly according to claim 1, wherein the first element is a hoop.

3. The mooring assembly according to claim 1, wherein the second element is a hook.

4. The mooring assembly according to claim 3, wherein the hook has a continuously curved body.

5. The mooring assembly according to claim 3, wherein the hook has a polygonal body.

6. The mooring assembly according to claim 2, wherein the hoop has an annular cross-section, a polygonal cross-section or an irregular cross-section.

7. A mooring assembly comprising:

first and second elements selectively attachable to a buoy and a boat, the second element being dimensioned to extend through the first element as the boat advances along a travel direction and to engage the first element as the boat reverses the travel direction after the second element has been carried through the first element; and a rod extending between and coupled to one of the first and second elements and the buoy, the rod extending through the buoy so that the buoy and the one of the first and second elements are displaceable relative to one another to vary the distance therebetween;

wherein the rod includes a telescopic structure having an outer receiving portion attached to the buoy and an inner portion insertable within the outer portion and fixed to the one of the first and second elements and displaceable relative thereto to vary the distance between the buoy and the one element.

8. The mooring assembly according to claim 7, further comprising a fastener locking the inner portion of the rod relative to the outer portion in the desired position.

9. A mooring assembly comprising a first element attachable to a buoy and a second element attachable to a boat and dimensioned to extend through the first element along a first direction as the boat advances along a travel direction and engage the first element upon displacement of the second element in a direction opposite to the first direction as the boat reverses the travel direction after the second element has been carried through the first element, and a shaft removably mounted on a bow of the boat and having a free end provided with the second element, wherein the shaft has a structure allowing adjustment of the overall length of the shaft, the shaft being pivotally mounted on the bow of the boat and having a locking mechanism for securing the shaft in the desired position.

10. A mooring assembly comprising a first element attachable to a buoy and a second element attachable to a boat and dimensioned to extend through the first element along a first direction as the boat advances along a travel direction and engage the first element upon displacement of the second element in a direction opposite to the first direction as the boat reverses the travel direction after the second element has been carried through the first element, and a shaft removably mounted on a bow of the boat and having a free end provided with the second element, wherein the second element includes leading and trailing hooks opening in opposite direction, the trailing hook being dimensioned and shaped to engage the first element including a hoop as the boat advances in the travel direction to prevent the uncontrollable displacement of the boat relative to the buoy after the leading hood has passed through the hoop.

11. The mooring assembly according to claim 10, wherein the trailing hook is larger than the leading hook.

12. A method of mooring a boat to a buoy, comprising the steps of:

selectively attaching a hook and hoop to the boat and buoy;

passing the hook through the hoop in one direction as the boat advances along a travel direction; and displacing the hook in a direction opposite the one direction to engage the hook with the hoop upon reversing the travel direction of the boat, thereby mooring the boat to the buoy, wherein the hook passes through the hoop at a first angle to a horizontal during advancement of the boat along the travel direction and is displaced in the opposite direction at a second angle differing from the first angle.

* * * * *